US011814257B2

(12) United States Patent
Verrall

(10) Patent No.: US 11,814,257 B2
(45) Date of Patent: Nov. 14, 2023

(54) ADHESIVE TAPE DISPENSER HEAD

(71) Applicant: JJS APPLICATION TECHNOLOGIES LTD, Coventry (GB)

(72) Inventor: Luke Verrall, Coventry (GB)

(73) Assignee: JJS APPLICATION TECHNOLOGIES LTD., Coventry (GB)

( * ) Notice: Subject to any disclaimer, the term of this patent is extended or adjusted under 35 U.S.C. 154(b) by 290 days.

(21) Appl. No.: 17/084,025

(22) Filed: Oct. 29, 2020

(65) Prior Publication Data

US 2022/0135361 A1 May 5, 2022

(51) Int. Cl.
*B65H 35/00* (2006.01)

(52) U.S. Cl.
CPC ..... *B65H 35/006* (2013.01); *B65H 35/0086* (2013.01)

(58) Field of Classification Search
CPC ..... B65H 35/0006; B65H 35/0013; B65H 35/006; B65H 35/0066; B65H 35/0073; B65H 35/008; B65H 35/0086
See application file for complete search history.

(56) References Cited

U.S. PATENT DOCUMENTS 3,991,708 A * 11/1976 Huebschmann ..... B05C 1/0813 118/247
4,003,780 A * 1/1977 Cohn ..... B31B 70/61 156/519
4,317,694 A * 3/1982 Fuchs ..... B32B 37/22 156/256
4,318,765 A * 3/1982 Fuchs ..... B32B 37/10 198/774.4
4,675,069 A * 6/1987 Mattei ..... B26D 1/385 226/125
5,429,576 A * 7/1995 Doderer-Winkler .... B31B 70/00 229/80.5
5,635,004 A 6/1997 Pazdernik et al.
5,776,285 A * 7/1998 Blumle ..... B31B 70/00 156/289
6,383,321 B2 * 5/2002 Kubert ..... B65C 9/30 156/542
6,569,074 B2 * 5/2003 Bluemle ..... B31B 70/261 271/186
11,459,203 B2 * 10/2022 Verrall ..... B65H 35/0013
2004/0035523 A1 2/2004 Middelstadt et al.
2020/0157750 A1 * 5/2020 Wilkens ..... B65H 35/0013
2021/0130121 A1 * 5/2021 Verrall ..... B65H 35/0013

FOREIGN PATENT DOCUMENTS

DE 102005009827 A1 9/2006
EP 2078689 A2 7/2009
NL 1012093 C 11/2000

* cited by examiner

*Primary Examiner* — Sean M Michalski
*Assistant Examiner* — Richard D Crosby, Jr.
(74) *Attorney, Agent, or Firm* — McCoy Russell LLP

(57) ABSTRACT

An adhesive tape dispenser head assembly arranged to dispense pieces of adhesive tape onto an object can include: a feed spool arranged to hold adhesive tape; and a tape launching cutter movable between a first configuration in which the tape launching cutter is arranged to launch the adhesive tape onto the moving object and a second configuration in which the tape launching cutter is arranged to cut the tape to a desired length.

13 Claims, 5 Drawing Sheets

ADHESIVE TAPE DISPENSER HEAD

CROSS REFERENCE TO RELATED APPLICATIONS

This application claims priority to United Kingdom Patent Application No. 1915757.7 filed Oct. 30, 2019, which is incorporated by reference herein in its entirety.

BACKGROUND

This invention relates to an adhesive tape dispenser head, an adhesive tape dispenser machine including said head and a method of dispensing adhesive tape.

Particularly, but not exclusively, the invention relates to an apparatus and method with integrated launch and cutting facility for dispensing pieces of adhesive tape onto an object. Ideally, but not essentially, tape is launched from the head such that its velocity matches the velocity of an object to which it is to be adhered.

Dispensing machines having dispensing heads that include cutters are used to dispense pieces of tape onto a moving object. In such dispensing machines (e.g. as disclosed in EP2078689), cutting of the tape to a desired length and dispensing of the cut tape precisely onto the object requires co-ordination between the cutting element and the dispensing element. This can be achieved via computer control—the head is a stand-alone element with its own control electronics which receives the work information from another master system via an interface of digital signals or via a network protocol. Objects are to be fed manually, or in an automated manner, onto a conveyor that conveys the objects past the dispenser head assembly. One or more speed and position sensors can provide data on the movement of the object relative to the head to a central processor, which co-ordinates dispensing of adhesive tape from the dispensing head onto the object when the object is in a correct position during its movement path. The cutting mechanism of the dispensing head is controlled by the central processor such that a desired length of tape is cut during the dispensing process.

In existing dispensing machines (e.g. of the type described in EP2078689), when a next piece of tape is to be attached to the moving object, the free end of the piece of tape is placed or pressed onto the object at the desired position in order to facilitate correct attachment. This placement/pressing is achieved, usually, by a dispensing head component that is movable (via a pneumatic or electronic drive) between a tape depositing position, in which the component bears against the tape to keep the tape tense and deposit the tape onto the moving object and an unengaged position in which the component does not deposit the tape onto the moving object. After the tape has been placed/pressed onto the moving object, the free end of the tape adheres to the object and the movement of the object pulls further tape along onto the object. The dispensing head includes a cutter arranged to cut the tape to a desired length. The dispensing machine also may include a freely rotating pressing roller arranged to press the tape onto the moving object to provide a clean, consistent application of pieces of tape onto the moving object.

Cutting of the tape is usually achieved by stabbing, with a blade, the tense tape from one side of the tape at a predefined point or location.

Furthermore, especially when cutting magnetic tape, or heavy tape, e.g. tape that is heavy or dense or thick in relation to the object material upon which the tape is to be adhered, it is challenging to cut through the tape consistently (to achieve a good quality cut) at speed—a cutting blade tends to wear out quickly as a result of cutting inconsistency. Examples of heavy tapes include magnetic tapes, 3M™ VHB tapes, certain heavy webbed mesh tapes and hook and loop (Velcro™) tapes. For the purpose of this specification, a tape can also be considered to be a heavy tape if it has a high unwind inertia or a slow release. Typical object materials include paper, cardboard, plastic (e.g. for laminate flooring) and fabrics—this list is not exhaustive. Objects with adhered tapes are used in many different markets, such as point-of-sale, printing, signage, flooring and promotional materials—this list is not exhaustive.

SUMMARY

Representative features are set out in the following clauses, which stand alone or may be combined, in any combination, with one or more features disclosed in the text and/or drawings of the specification.

According to an a first aspect of the invention, we provide an adhesive tape dispenser head assembly arranged to dispense pieces of adhesive tape onto an object, the assembly comprising: a feed spool arranged to hold adhesive tape; a tape launching cutter movable between a first configuration in which the tape launching cutter is arranged to launch the adhesive tape onto the moving object and a second configuration in which the tape launching cutter is arranged to cut the tape to a desired length.

The tape launching cutter may be movable to a third configuration in which the tape launching cutter is arranged to allow the tape to flow freely past, wherein the tape launching cutter is arranged to move in sequence from the first configuration to the third configuration to the second configuration. The tape launching cutter may be movable to a fourth configuration in which the tape launching cutter is arranged to hold the tape after the tape has been cut and prior to subsequent launch of the tape, wherein the tape launching cutter is arranged to move in sequence from the second configuration to the fourth configuration. The tape launching cutter may be movable to a fifth configuration in which the tape launching cutter is arranged to brake the tape before the tape is cut, wherein the tape launching cutter is arranged to move in sequence from the fifth configuration to the second configuration.

The tape launching cutter may comprise a first cutting member and a second cutting member, wherein one or both of the first cutting member and the second cutting member are movable and are arranged to cooperatively cut the tape during the cutting operation. The first cutting member may be arranged to cut the tape from a first side of the tape, and the second cutting member is arranged to cut the tape from a second, opposite side of the tape. The first cutting member may comprises a first cutting surface and the second cutting member may comprise a second cutting surface; or one of the first cutting member and the second cutting member may comprise a cutting surface and the other of the first cutting member and the second cutting member comprises a counterpart cutting base.

The tape launching cutter may be arranged to launch the adhesive tape onto the moving object such that, upon initial contact between the tape and the object, the speed of the tape substantially matches the speed of the object. The tape may have two sides and the tape launching cutter may be arranged to engage the tape from both sides during the launch operation, the cutting operation or both. The tape launching cutter may comprise a rotating roller comprising a launch portion arranged to grip and move the tape to launch the tape, and a cutting portion having a cutting surface, such as a cutting blade, arranged to cut the tape, and wherein the roller is arranged to rotate between the first and second configurations. The rotating roller may further comprise a non-engaging portion, such as a recessed portion, arranged to allow the tape to flow past the tape launching cutter. The rotating roller may further comprises a holding portion arranged to hold the tape after the tape has been cut and prior to subsequent launch of the tape, and/or may comprises a brake portion arranged to brake the tape before the tape is cut.

The tape launching cutter may comprises a pair of rotating rollers, wherein both rollers are aligned and cooperate to form any one or more of: the launch portion; the cutting portion; the non-engaging portion; the holding portion; and the brake portion.

The tape launching cutter may comprises: one, or a pair of, first rotating rollers comprising a launch portion arranged to grip and move the tape to launch the tape, and optionally the one, or pair of, first rotating rollers is further arranged to subsequently release the tape to allow the tape to flow freely past the launch portion; or alternatively a movable clamp arrangement having a pair of linearly movable clamp members arranged to launch the adhesive tape, wherein the movable clamp members are arranged to grip and move the tape, and optionally the movable clamp members are further arranged to subsequently release the tape to allow the tape to flow past the launch mechanism.

In embodiments of the technology, the tape launching cutter may comprise:

a. a movable guillotine cutter having a cutting blade and a cutting block, wherein relative movement between the cutting blade and the cutting block is coordinated to cut the tape; or
b. a pair of second rotating rollers comprising a cutting blade and a cutting block, wherein relative movement between the cutting blade and the cutting block is coordinated to cut the tape; or
c. a pair of second rotating rollers comprising a first cutting blade and a second cooperating cutting blade, wherein relative scissor movement between the first and second cutting blades is coordinated to cut the tape; or
d. a single second roller comprising a cutting blade and arranged to cut the tape under tension; or
e. a rotating cutting blade and a stationary cutting block, wherein relative movement between the cutting blade and the cutting block is coordinated to cut the tape, and optionally wherein the cutting block is formed from an internally rectified cylinder and the rotating cutting blade is mounted concentrically with the internally rectified cylinder.

The tape launching cutter may comprise multiple components driven by a common motor, such as a servo-motor, and optionally wherein a gear system connects the multiple components to the motor. The tape launching cutter may be arranged to receive instructions from a controller arranged to control operation of the tape launching cutter. The controller may be arranged to control operation of the tape launching cutter based on: (a) object speed information relating to the relative speed of the object compared to the dispenser head assembly; or (b) presence information relating to detection of the presence of the object at a first location or position information relating to the relative position of the object compared to the dispenser head assembly; or both (a) and (b). The controller may be arranged to control operation of the common motor.

In embodiments of the technology, the object may be conveyed on a conveyor and the object speed information is determined from the conveyor speed; or the object speed information is directly sensed by an object speed sensor; or the object speed information is input via a user interface; or the object speed information and the position information is pre-programmed.

The adhesive tape dispenser head assembly may include a guide arrangement to guide the adhesive tape from the feed spool to the tape launching cutter, and optionally wherein the guide arrangement comprises one or more guide rollers, such as one or more free rollers. The adhesive tape dispenser head assembly may further comprise a press roller located at or near to the location of initial contact between the adhesive tape and the object; and optionally the press roller may comprise an adjustable press roller arranged to be adjustable to facilitate varying initial contact points based upon the precise in-use configuration or the object thickness or the adhesive tape thickness or a combination thereof.

The adhesive tape may be provided on a backing liner layer, and the feed spool may be arranged to hold the adhesive tape and the backing liner layer, and the assembly further comprising a take-up spool arranged to collect the backing liner layer, and optionally the adhesive tape dispenser head assembly further comprises a spool gear mechanism between the feed spool and the take-up spool. The adhesive tape dispenser head assembly may further comprise an attachment device arranged to facilitate attachment of the assembly to a tape applicator machine. The tape launching cutter may be arranged to carry out the tape launching operation upstream of the tape cutting operation. The adhesive tape dispenser head assembly may comprise a heavy adhesive tape dispenser head assembly arranged to dispense pieces of magnetic adhesive tape or heavy adhesive tape onto an object.

According to a second aspect of the invention, we provide a tape application machine comprising an adhesive tape dispenser head assembly according to the first aspect of the invention, and a relative movement mechanism arranged to provide movement between the object and the dispenser head assembly wherein the dispenser head assembly is arranged to dispense pieces of adhesive tape onto the object. The relative movement mechanism comprises a conveyor for conveying the object.

According to a third aspect of the invention, we provide a method of dispensing pieces of adhesive tape onto an object comprising: obtaining relative object speed and presence information; and in response to the relative object speed and presence information, using the tape launching cutter of the first aspect of the invention to cut and dispense pieces of adhesive tape onto the object such that, upon initial contact between the tape and the object, the speed of the tape substantially matches the speed of the object. Obtaining relative object speed information may comprise: when the moving object is conveyed on a conveyor, determining the object speed from the conveyor speed; measuring the object speed; obtaining pre-programmed object speed information and position information; or obtaining object speed information input via a user interface. The tape may have two sides and the tape launching cutter may be arranged to engage the tape from both sides.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

Although certain example embodiments of the invention have been described, the scope of the appended claims is not intended to be limited solely to these embodiments. The claims are to be construed literally, purposively, and/or to encompass equivalents.

BRIEF DESCRIPTION OF THE DRAWINGS

Embodiments of the invention will now be described, by way of example only, with reference to the accompanying drawings, in which.

DETAILED DESCRIPTION

Figure 1:
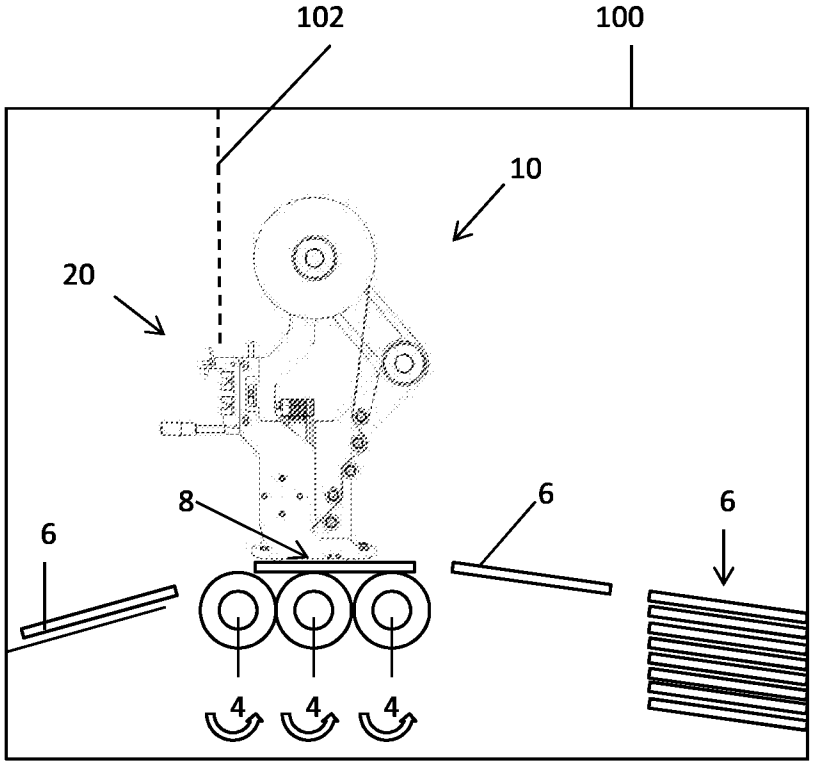
FIG. 1 shows schematically parts of a tape application machine according to an aspect of the invention.
Figure 3:
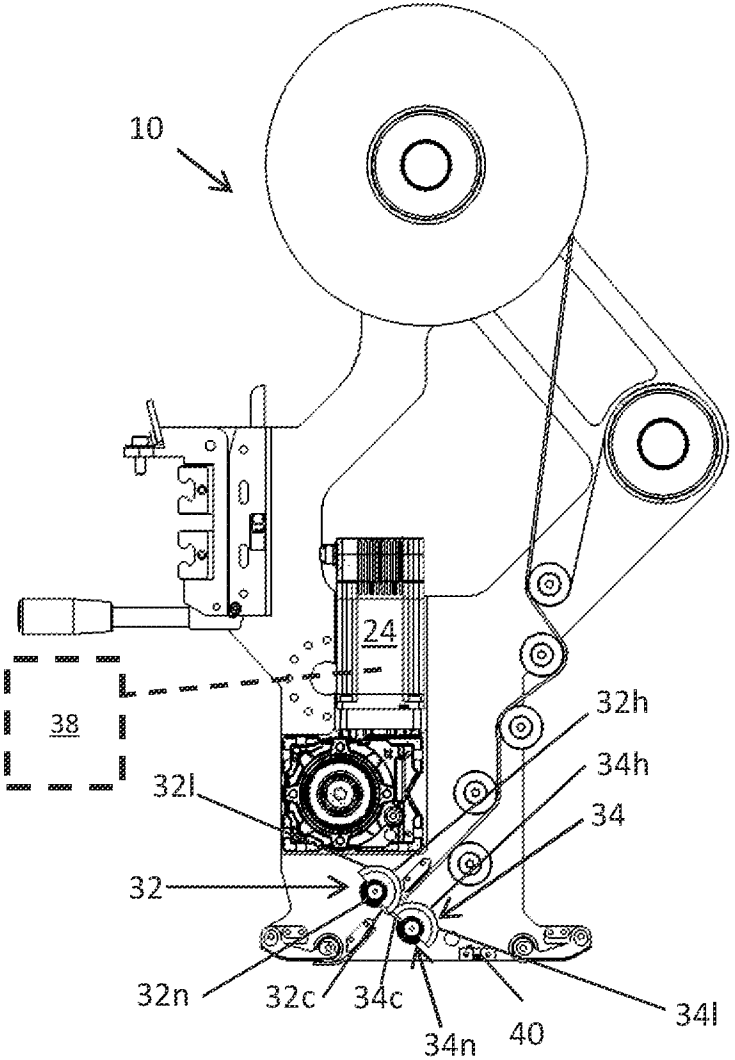
FIG. 3 shows schematically the adhesive tape dispenser head assembly of FIG. 2 from one side.

Referring to FIG. 1, there is shown part of a tape application machine 100, according to an embodiment of the invention, which is used to apply pieces of tape to objects in a controlled, desired manner. The tape application machine 100 includes a conveyor system, which in this embodiment comprises three conveyor rollers 4 arranged in a standard manner. Curved arrows in FIG. 1 show the rotation directions of the conveyor rollers 4. Objects 6 upon which tape pieces are to be applied travel on the conveyor rollers 4 through a deposition zone 8, past an adhesive tape dispenser head assembly 10 according to the invention, which is arranged to cut and deposit tape pieces on to the objects. In other embodiments, the conveyor system may comprise a different number of rollers. In other embodiments, the conveyor system may comprise a non-roller system, such as a driven track or belt that conveys objects through the deposition zone 8—the belt or track may be driven by rollers or axles or any other suitable mechanism.

In this embodiment, objects 6 are manually fed to the conveyor system. In other embodiments, objects 6 may be automatically fed to the conveyor system by an automated feeder. In some embodiments, there may be a guide mechanism, such as a rail to ensure correct lateral alignment of an object through the deposition zone (e.g. an edge of the object may be aligned with the guide mechanism such that the object is correctly presented in the deposition zone).

The tape application machine comprises a frame 102 to which the adhesive tape dispenser head assembly (of one embodiment of the invention) 10 is attachable. Attachment between the frame 102 and the dispenser head assembly 10 is such that the conveyor rollers 4 convey objects in a controlled manner past the attached dispenser head assembly 10. The frame comprises a gantry upon which one or more dispenser head assemblies can be mounted in a conceptually known manner. Typically multiple head assemblies can be mounted across a gantry such that objects passing thereunder can have tape pieces applied at one or more locations across their width. For ease, the invention will be described with reference to a single dispenser head assembly, although the invention might be used with multiple dispenser head assemblies. In this embodiment, the assembly is fixed and stationary relative to the frame 102. In other embodiments, the head assembly may move relative to a frame, and the object or objects upon which tape is to be adhered may be stationary. Or, both the head and the object(s) may move in other embodiments.

Apart from the dispenser head assembly 10, the rest of the machine is of standard construction. The inventive dispenser head assembly may be retro-fitted to an existing adhesive tape dispensing machine that is able to receive head assemblies.

The dispenser head assembly 10 includes attachment device 20 for releasably attaching the assembly to the machine 100, and in particular to the frame 102 of the machine. In this example, the attachment device 20 is in the form of a clamp module operable by a handle. The clamp module is arranged to clamp to a corresponding part of the machine frame when correctly aligned therewith. The handle moves the clamp mechanism between an open configuration in which the assembly is not attached to the machine, and a clamped configuration in which the clamp secures against a corresponding part of the frame to secure the assembly on the machine. The attachment device may have a quick release mechanism.

The objects 6 pass through the deposition zone 8 where the depositing of tape pieces onto a passing object occurs. In this embodiment, the invention includes known means for detecting the presence of a passing object and predicting when it is in correct position in the deposition zone for having a tape piece deposited upon it. In other embodiments, the relative position between the head assembly and the object is otherwise provided—for example, in embodiments having a moving head assembly movable over a stationary object, the object may be located in a known position and orientation on a reference bed, and the moving head assembly may be calibrated such that the precise alignment relative to the object is known.

Each tape piece is of a desired size (length) and is precisely positioned on each object as it passes through the deposition zone 8. The machine of this invention can achieve speeds of 80 to 100 m/minute, even when depositing heavy tape or magnetic tape. This is a significant improvement over existing machines and features that lead to this effect are described below. The features need not necessarily be used in combination. Each feature offers an advantage over existing machines.

In machines that use replaceable dispenser head assemblies, it is challenging to provide a compact arrangement, as the present solution elegantly provides, because of the requirement to co-ordinate a complex cutting mechanism with a depositing mechanism. Dispensing pre-cut or pre-formed adhesive labels onto an object such as a moving object (e.g. on to objects such as envelopes) is not so complicated because machines for such dispensing do not require such complex cutting mechanisms, since the labels are already formed as desired, perhaps with a pre-cut or score. In this invention, a further complex launch mechanism has also been provided. This launch mechanism allows use with heavier tapes, which are traditionally difficult to cut effectively with the required speed of throughput. Machines with replaceable heads are more versatile—different heads might be used in different configurations depending upon the specific tape and object combination. Different numbers of heads can be mounted in parallel onto the machine frame such that multiple pieces of tape can be applied across the width of an object passing through the machine. Machines with replaceable heads are also easier to service and repair than those without such heads. It can be seen that replaceable dispenser head assemblies are subject to different technical requirements than machines for dispensing pre-cut labels.

The adhesive tape dispenser head assembly 10 is arranged to automatically dispense pieces of adhesive tape onto a moving object 6. The pieces of tape are cut from a roll of adhesive tape 12. In this example, the tape is a magnetic tape and is provided on a backing liner 14 in a standard manner. Heavy tapes and magnetic tapes are traditionally provided with a liner, whereas other lighter tapes can be provided without a liner—this invention can also work with such lighter tapes). Magnetic Tape and Velcro are typically one-sided adhesive tapes, which have a liner that covers the adhesive side. In order for these materials to bond to the passing substrate/object, the liner needs to be removed to expose the adhesive so that it can stick to the passing substrate. Double sided adhesive tapes already typically have one side exposed as they pass from a feed mechanism through the dispenser head assembly—double sided adhesive tapes do not normally need the liner covered side to be removed; although, this can also be an option and sometimes desirable. Advantageously, this invention provides a head assembly that can be used with a broad range of tapes (light or heavy; one-sided adhesive or two-sided adhesive) whilst still providing pieces of tape that have clean, consistent cuts and whilst operating at desired speeds.

Figure 2:
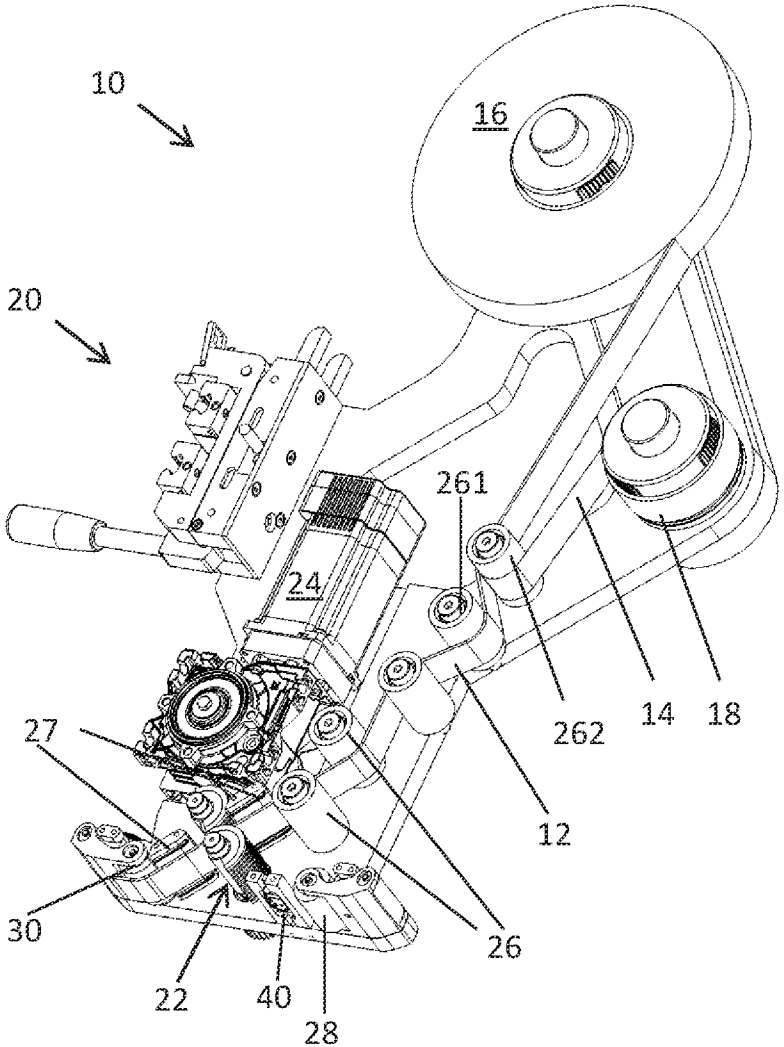
FIG. 2 shows schematically a part of an adhesive tape dispenser head assembly according to another aspect of the invention.

As shown in FIG. 2, the assembly 10 comprises: a feed spool 16 arranged to hold the adhesive tape 12 and liner 14; and a take-up spool 18 arranged to hold the backing liner 14 after the tape has been peeled off therefrom. In other embodiments (e.g. those where there is no backing liner), there is no take-up spool.

In this embodiment, the assembly 10 comprises a spool gear mechanism (not shown) between the feed spool and the take-up spool. At the start of a roll, the tape is substantially entirely wound on the feed spool—most weight is distributed on the feed spool. By the end of the roll, the feed spool is largely empty, whilst the take-up spool contains substantially all of the backing liner—most weight is then distributed on the take-up spool. The spool gear mechanism compensates for this changing balance between the spools in order to maintain tape tension throughout the process. The take up spool 18 is arranged to recover and remove liner 14 as the outside diameter of the take up spool 18 is substantially smaller than that of the outside diameter of 16 the feed spool. Therefore, in this embodiment, a 1:4 ratio gearing is applied between the spools to ensure the 'take up' is adequate. In other examples, instead of (or in addition to) the spool gear mechanism, a further take-up motor is provided. The take-up motor controls the uptake of the liner, and thereby provides good uptake control, e.g. avoids issues towards the very end of the roll, whereby the tension can otherwise interfere with the liner flow.

Figure 4:
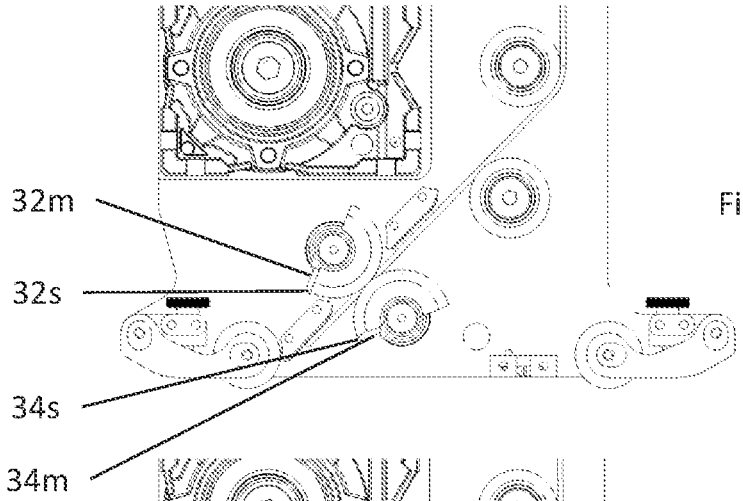
FIG. 4 shows schematically the adhesive tape dispenser head assembly of FIG. 2 in a configuration.
Figure 6A:
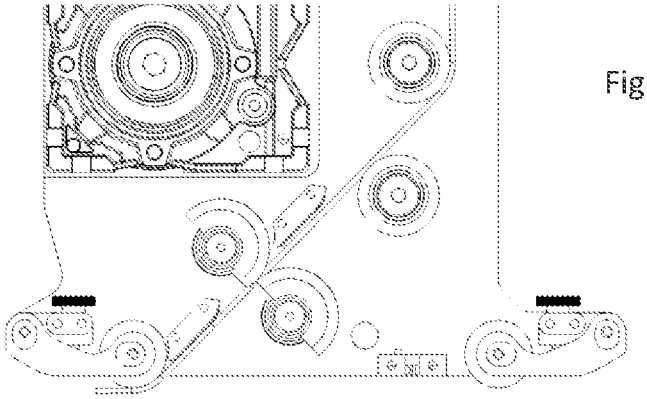
FIGS. 6*a* and 6*b* show schematically the adhesive tape dispenser head assembly of FIG. 2 in another configuration.
Figure 6B:
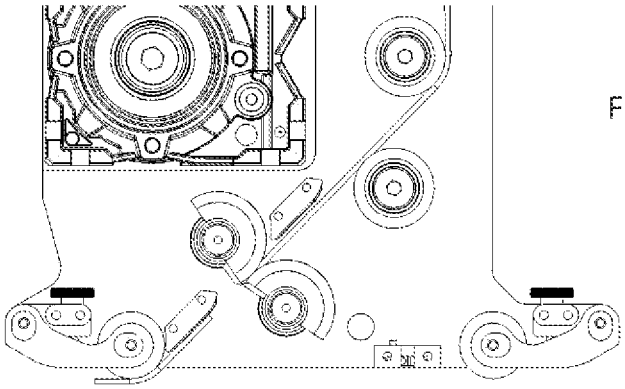

The assembly 10 also includes a tape launching cutter 22. The tape 12 is arranged to travel downstream from the feed spool, be separated from the backing liner 14 and then travel further downstream to the tape launching cutter, which is movable between a first configuration (as seen in FIG. 4) in which the tape launching cutter is arranged to launch the adhesive tape onto the moving object and a second configuration (as seen in FIGS. 6*a* and 6*b*) in which the tape launching cutter is arranged to cut the tape to a desired length. The tape launching cutter 22 is connected to a motor 24 which drives movement thereof. In this embodiment the motor is a servomotor, which allows precise movement of the tape launching cutter between its configurations. The precise form of the tape launching cutter of this embodiment is described in further detail below.

The tape 12 is arranged to travel from the tape launching cutter further downstream to the deposition zone 8. To achieve this, the tape launching cutter 22 is arranged to launch the tape such that when the tape first contacts the moving object 6 in the deposition zone, the tape is already moving in a direction substantially parallel to the object movement direction, or the tape has a velocity with a significant speed component in a direction parallel to the movement direction of the object. The aim is to have the tape and object travelling at the same speed in the same direction as far as possible at the moment of impact to reduce disruption when the tape meets the moving object. At least, upon contact, the relative velocity between the tape and the object should be less than the relative velocity between the assembly and the object—thereby an advantage relative to existing depositing systems (of the type where tape is pressed on to a passing object) is provided. In this way, this invention advantageously provides the ability to adhere heavy tape or magnetic tape to an object. Heavy tape may be defined as tape that is heavier or denser or stiffer than an object to which it is being adhered. For example, pieces of magnetic tape being adhered to paper or cardboard are usually problematic to adhere repeatably and quickly without disruption.

The launch feature of this invention provides an improvement in reliably adhering tape to an object (particularly when the tape is relatively heavy compared to the object) compared to simply pressing stationary tape onto a moving object.

In this embodiment, the tape launching cutter 22 is arranged to launch the adhesive tape onto the moving object such that, upon initial contact between the tape and the object, the speed of the tape substantially matches the speed of the object. In some embodiments, the launch speed of the tape might be from 70% of the speed of the moving object. In some embodiments, the launch speed of the tape might be up to 110% of the speed of the moving object. In some embodiments, the launch speed of the tape might be between 70% and 110% of the speed of the moving object. In embodiments in which the tape head moves and the object is stationary, or in which both move, then the tape is launched such that the relative speed between the tape and the object is about zero (zero or +/−30%) upon initial contact between the tape and the object.

Launching and cutting the tape is co-ordinated such that the right amount of tape is adhered in the right location to the object or substrate. Co-ordination can be computer controlled in a similar manner to that described in known machines, as described in the background section. Sensors in such a system may be mounted or located on the dispenser head assembly or remotely (e.g. on the machine itself). Information gathered from the sensors is traditionally useful to coordinate cutting and depositing tape. In this invention, the information is also used to coordinate launching the tape prior to cutting. In this embodiment, precise control can be achieved by using a single servomotor to drive the cutting and the launching—this is particularly important for co-ordinating the launching, which must be precise and is often at high speed. Example speeds of the conveyed object are as cited above. Instead of being sensed, speed information may be known due to knowledge of the precise relative speed and position relationship between the object and the head assembly. For example, in embodiments with a movable head and a stationary object, the head may move in a controlled manner in which its speed and position are known or monitored. This leads to relative speed and position information that is useful to co-ordinate precise launching and cutting of the tape. Precise launching includes taking into account the distance from the tape launching cutter 22 to the deposition zone, and the relative speed and position information to determine when the object will be in the deposition zone.

Having the tape launching and the tape cutting mechanisms on a single mechanism has the effect that the entire operation is made more efficient—better co-ordination between the launch and the cutting process is provided leading to a better quality of cut and the ability to reliably adhere heavy or magnetic tape to regular substrates.

The tape 12 has two sides and the tape launching cutter 22 is arranged to engage the tape from both sides during the launch operation and the cutting operation in this embodiment. In other embodiments, the tape may be engaged from only one side for either or both operations—this might be facilitated by the tape being under tension and so only requiring to be engaged from one side (against tension) to achieve the desired launch or the desired cut. However, engaging the tape from both sides provides an advantageous effect in allowing more precise and repeatable launch and/or cut operations.

In this embodiment, as shown in FIGS. 1 to 6, the tape launching cutter comprises a pair of rotating rollers—a first rotating roller 32 and a second rotating roller 34. Both rollers are aligned and cooperating surfaces on each roller combine to form the tape launching cutter. The rotation of the rollers 32, 34 is driven by a servomotor 24 that is controlled by a controller (not shown). Rotation of each roller 32, 34 is driven by a single motor 24 and gear system and is co-ordinated such that parts of each roller combine to engage the tape to provide the desired effect on the tape. The pair of rotating rollers 32, 34 provides a particularly advantageous solution to the problem of how to efficiently attach cut pieces of heavy tape to an object. Other embodiments also offer advantages relative to known systems and are within the scope of the claims.

A launch portion **32*l*, 34*l*** of the tape launching cutter is formed by co-operating roller surfaces that are arranged to grip the tape so that the tape can be thrown or launched effectively downstream towards the deposition zone. The roller surfaces, in this embodiment, are formed of a material that has suitable adhesion and grip properties—in this example, the roller surfaces are formed of an anti-adhesive material (so that the tape does not stick to the rollers) and a high grip material (so that the tape is able to be gripped and thrown precisely when the rollers are moved); in this example, the roller surface comprises a silicone rubber material.

In this embodiment, the roller surface is configured to be flexible in a radial direction such that a relatively wide range of tapes of differing thickness can be accommodated through the tape launching cutter. The roller surface may comprise a silicone rubber material, such as a softer silicone rubber material. The radial flexibility is provided in one this particular example by having a roller surface with gaps between parts of the surface that are arranged to contact the tape (see FIG. 10, and accompanying description below). The gaps allow some movement of the parts of the surface that are arranged to contact the tape such that radial flexing is facilitated. The gaps and the parts of the surface that are arranged to contact the tape may run parallel to each other in a direction of travel of the tape. Radial flexing may not be required, or not much may be required, when a thin tape passes through the tape launching cutter, whereas more radial flexing may be required when a thick tape passes through the tape launching cutter—the same flexible roller surface can work with thinner tapes and thicker tapes. In some such examples, advantageously the same flexible roller surface can work with tape thicknesses from 0.1 mm to 0.3 mm. In some such examples, the roller surface depth (i.e. depth of silicone rubber material) is about 5 mm, and the depth of the gaps is about 1.5 mm. The skilled person will understand that this feature is not limited to these examples.

In some examples, the silicone rubber material may comprise a hard silicone rubber material, and may comprise a silicon surface layer about 0.1 mm to 2 mm thick.

Figure 5:
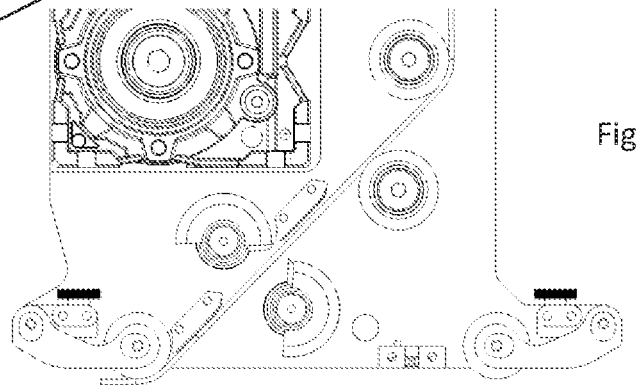
FIG. 5 shows schematically the adhesive tape dispenser head assembly of FIG. 2 in another configuration.

A non-engaging portion **32*n*, 34*n* of the tape launching cutter is formed by co-operating recessed portions formed in the roller surfaces. As the pair of rollers rotates, both non-engaging portions 32*n*, 34*n* come together to release the tape therebetween. In this embodiment, the non-engaging portions 32*n*, 34*n* are provided immediately after the end of each launch portion 32*l*, 34*l* and are configured to allow release of the tape immediately after launch. The launch portion allows movement of the tape launching cutter 22, in this embodiment (in other embodiments, this feature is not available), to a third configuration (as seen in FIG. 5**) in which the tape launching cutter is arranged to allow the tape to flow freely past, wherein the tape launching cutter is arranged to move in sequence from the first configuration to the third configuration to the second configuration. This third configuration facilitates dispensing of varying lengths of adhesive tape. Computer control can be used to program any required length of release phase (when the tape is allowed to flow freely past), e.g. zero or short for short tape piece lengths, or long for long tape piece lengths.

Having the tape launching and tape cutting mechanism on a single co-ordinated pair of rollers has the effect of making the system compact and efficient. Such a system is easy to computer control, and can be easily controlled by a single motor. The invention works in a continuous process without needing to stop the substrate (as is usually needed when adhering heavy tape pieces to an object). The combined cylindrical launch and cutting (cutting as the tape is being fed through the tape launching cutter) mechanism facilitates this effect.

In this embodiment, the assembly also comprises a first press roller 28, which is located upstream of the deposition zone 8. When the assembly is correctly attached to the machine, components of the assembly 10 and the machine 100 are correctly aligned, including the first press roller 28 with the conveyor system. The first press roller 28 presses passing objects 6 against the conveyor rollers 4 to facilitate consistent presentation of objects through the deposition zone—this feature is desirable for consistent and accurate adhesion of tape pieces onto each object. In other embodiments, no press mechanism may be provided, or a different press mechanism may be provided, e.g. a non-roller presser.

Once the tape has made initial contact with the object (passing through the deposition zone in a neatly presented manner in this embodiment), the tape adheres to the object.

In this embodiment, the assembly also comprises a second press roller 30, which is located downstream of the deposition zone 8. The second press roller 30 presses the recently adhered tape piece against the object 6 to facilitate reliable and consistent adhesion therebetween. In other embodiments, no press mechanism may be provided, or a different press mechanism may be provided, e.g. a non-roller presser.

Either or both of the first and second press rollers may be adjustable in height (distance from the conveyor system) via first and second height adjustment mechanisms respectively to allow adjustment for different object thicknesses and different tape thicknesses. This feature is particularly useful for heavy or magnetic tapes (which tend to be thicker than other tapes).

The tape 12 is then pulled along by the movement of the adhered object (since the object is being conveyed by the driven conveyor system, i. e. in this embodiment the conveyor rollers 4)—the tape therefore moves freely past the tape launching cutter, with which it is no longer engaged (since the tape launching cutter has rotated to its non-engaging portion after releasing the tape). In other embodiments, a different form of tape launching cutter may be provided, in which during the third configuration the tape is lightly engaged with the tape launching cutter such that the tape can slip past or be dragged past the tape launching cutter. The tape launching cutter 22 can be held in its non-engaging position for as long as desired in order to provide a requisite length of tape.

In embodiments without a third (release) configuration, the tape launching cutter may be sized and configured to provide precisely the required length of tape since the size of each tape piece will be fixed. Embodiments with a third configuration provide greater flexibility.

A cutting portion 32*c*, 34*c* of the tape launching cutter is formed by co-operating cutting blades that protrude from each roller surface at the end of each non-engaging portion 32*n*, 34*n*. The co-operating cutting blades are arranged to engage the tape from both sides to cleanly cut the tape. As the pair of rollers rotates, both cutting blades come together to engage the tape therebetween, and to cleanly cut the tape. In this embodiment, the cutting blades both have a straight cutting edge presented perpendicularly to the tape. In other embodiments, the cutting blades may have straight edges presented at a different, non-perpendicular angle. In other embodiments, the cutting blades may have corresponding curved edges.

A holding portion 32*h*, 34*h* of the tape launching cutter is formed by co-operating roller surfaces provided immediately after the end of each cutting portion 32*c*, 34*c* so that the tape can be held immediately after cutting until desired. As the pair of rollers rotates, both holding portions 32*h*, 34*h* come together to hold the tape therebetween. The tape is held until subsequent launch (instructed by the controller to the servomotor, which drives each roller). The roller surface material has grip properties sufficient to grip and hold the tape in the holding portion. The tape launching cutter 22 is thereby movable, in this embodiment (in other embodiments, this feature is not available), to a fourth configuration (similar to the configuration shown in FIG. 4, but when the tape launching cutter is not moving) in which the tape launching cutter is arranged to hold the tape after the tape has been cut and prior to subsequent launch of the tape, wherein the tape launching cutter is arranged to move in sequence from the second configuration to the fourth configuration. The holding portion and the launching portion are formed by the same rollers surfaces in this embodiment. The skilled reader will realise that upon initial set-up or initial use of the assembly, there is no prior cut—in this scenario, the tape is usually manually fed through the tape launching cutter and loaded into a start position. In some examples, upon initial set-up or initial use, a calibration feature is provided to aid the user. In such examples, a calibration sensor (not shown) is arranged to sense the rotational position of the rotating rollers 32, 34. The calibration sensor may be mounted on the assembly 10. Sensing the rotational position of the rotating rollers 32, 34 may be achieved by the calibration sensor monitoring the physical position of a rear axle or gear mechanism associated with the, or each, rotating roller 32, 34, and comparing it with a datum position measured at the time of first manufacturing/in factory set-up. A user is able to press a first initialisation button (not shown), which may be provided on a user interface associated with the controller, in order to move the rollers 32, 34 to a desired first initial position. In one embodiment, in the desired initial position, the cutting portions 32*c*, 34*c* are in contact with each other. Tape is then manually fed through the tape launching cutter and loaded up to the rollers 32, 34. The user is able to press a second initialisation button (not shown), which may be provided on a user interface associated with the controller, in order to move the rollers (approximately 90 degrees in one example) 32, 34 to a desired second initial position, in which the tape is gripped between the rollers 32, 34 in the start position, and the assembly is ready for subsequent use.

In some embodiments (not shown in this embodiment), the tape launching cutter 22 is able to move to a fifth configuration in which the tape launching cutter is arranged to brake the tape before the tape is cut, wherein the tape launching cutter is arranged to move in sequence from the fifth configuration to the second configuration. The brake may bring the tape to a standstill or to a low desired speed in order to facilitate a clean cut. This may be achieved by having a, preferably short, grip portion in between the release portion and the cutting blade on the tape launching and cutting rollers. The grip portion is able to grip the tape after the non-engaging portion has been passed to slow the tape down just prior to cutting.

In some embodiments, one of the rotating rollers comprises a mandrel roller, and the other roller comprises a rubber-surfaced roller (the surface may be integral to the roller or provided via a sleeve) as previously described. A cutting blade may be provided only on the rubber-surfaced roller and not on the mandrel. Other elements of the roller pair combine to provide the (launch, non-engaging, cutting, holding, and optionally braking) features described above. The rollers combine to provide an effective die-cut mechanism, and are particularly (but not exclusively) useful for cutting hook and loop (e.g. Velcro™) tapes.

In this embodiment, the rotating rollers 32, 34 are cylindrical and rotate about their cylinder axes. In other embodiments, the rotating rollers may not be cylindrical. The skilled reader will be able to envisage alternative shapes, e.g. the non-engaging portion 32*n*, 34*n* may be provided by a section of slightly reduced radius rather than a recessed portion. The roller surface, instead of being recessed, may simply be irregularly shaped.

In this embodiment, a pair of co-ordinated, co-operating rollers 32, 34 combine to provide the various functions (launch, release, cut, hold) of the tape launching cutter. In other embodiments, there may be only some of these functions provided (as per the claims)—the launch and cut functions are essential. In this embodiment, the concept of the two synchronized rollers is important—they are able to hold the tape, throw it (at the same speed) as the substrate and once the tape is glued to the substrate, release it from the socket. When it is to be cut, it is cut by a rotary scissor or guillotine system and at the same time the previous tape is held in place and repositioned ready for the next cycle.

In other embodiments, a single roller may provide the various functions (launch, cut, and optionally release and/or hold) of the tape launching cutter. As previously mentioned, the single roller would be able to provide said functions if a tense tape is provided; in that case, the tape need only be engaged from one side by the tape launching cutter to provide said functions.

In such alternative embodiments where a single roller provides the various functions, the tape launching cutter comprises a single rotating roller 32 having a launch portion 32*l* arranged to grip and move the tape to launch the tape, and a cutting portion 32*c* having a cutting surface, such as a cutting blade, arranged to cut the tape, and wherein the roller is arranged to rotate between the first and second configurations.

The single rotating roller 32 further comprises a non-engaging portion 32*n*, such as a recessed portion, arranged to allow the tape to flow past the tape launching cutter. The blade is located at an edge of the launch portion or, if present (as in this embodiment), the non-engaging portion.

The single rotating roller 32 further comprises a holding portion 32*h* arranged to hold the tape after the tape has been cut and prior to subsequent launch of the tape. In this embodiment, the launch and holding portions overlap—they are provided by a common surface of the roller 32.

The single rotating roller 32 further comprises an optional brake portion (not shown) arranged to brake the tape before the tape is cut.

In general (across the above-mentioned embodiments), the launch and the cutting mechanism is provided on a single unit (e.g. the single roller 32), or on a single complementary pair of units (e.g. the pair 32, 34 of rollers) that has complementary parts of the launch or/and cutting portions on each roller 32, 34. Either way, a compact, accurate tape cutting and launching mechanism is provided.

In embodiments where the tape launching cutter comprises one or more rollers, the or each roller may comprise a driven base (such as a driven core or axle), and a roller attachment, such as a sleeve, that attaches to the driven base. In the embodiments shown in FIGS. 1 to 6, the rotating rollers 32, 34 are each made up of such a driven axle and sleeve arrangement. The two sleeves respectively comprise the launch portions 32*l*, 34*l*, the non-engaging portions 32*n*, 34*n*, the cutting portions 32*c*, 34*c* and the holding portions 32*h*, 34*h*. Advantageously, it is possible to change the sleeves only to alter the function of the cutting operation—the whole cutting assembly need not be changed. For example, if a particular blade type is required for a particular tape. Or, if a roller having a smaller diameter is needed (to provide shorter tape pieces—since the minimum tape piece is determined by the distance between the launch and cutting portions).

In this embodiment, the sleeve comprises a roller surface that is configured to be flexible in a radial direction such that a relatively wide range of tapes of differing thickness can be accommodated, as discussed previously. Examples of the sleeve include examples having the properties discussed previously. The sleeve may be attached to the driven base by two bolts, in one example—this provides ease of removal for repair or replacement.

Figure 10B:
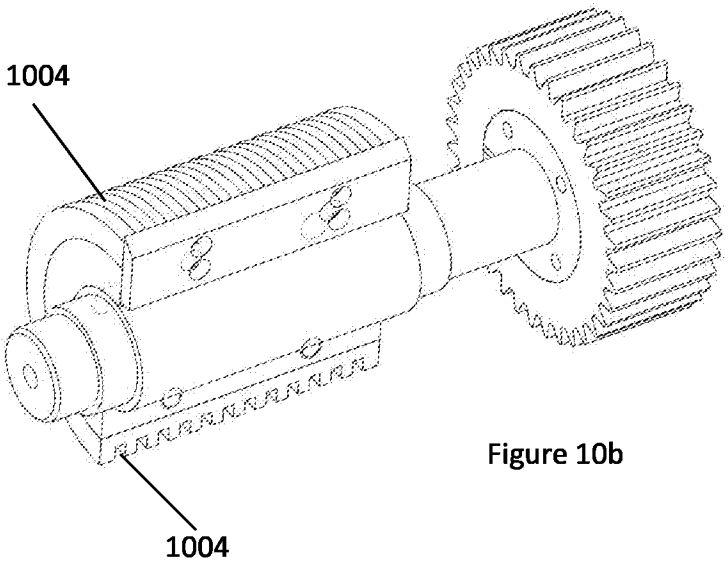
FIGS. 10*a*, 10*b* and 10*c* show a roller sleeve arrangement of the adhesive tape dispenser head assembly of FIG. 2.
Figure 10C:
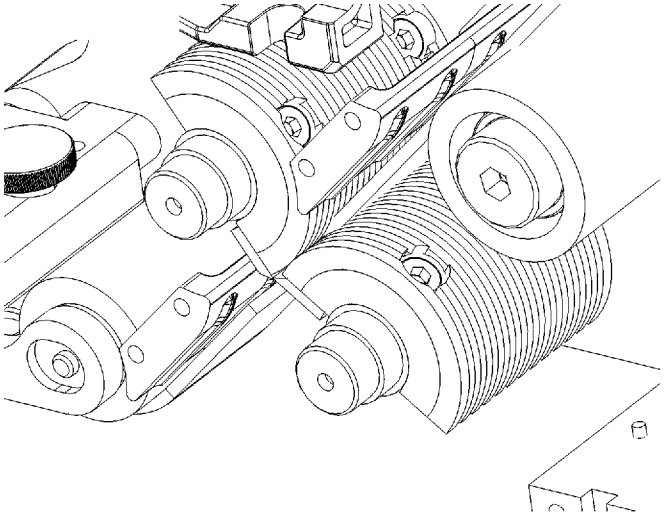
Figure 10A:
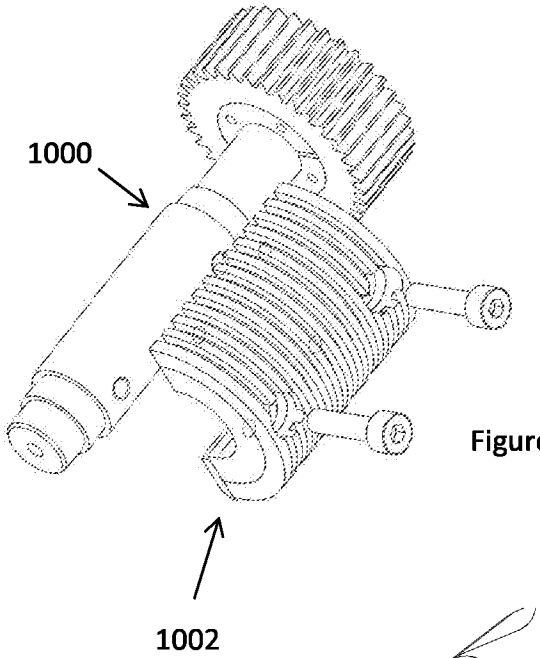

An example of such a sleeve 1000 and driven base 1002 is shown in FIGS. 10*a* and 10*b*, which show some further detail compared to the earlier figures. This sleeve 1000 comprises a silicone rubber material that is radially flexible. The sleeve's radial flexibility is enhanced by the longitudinal gaps 1004 running along its surface. The gaps have a depth of about 1.5 mm. The sleeve 1000 is about 5 mm thick. Accordingly a good range of heavy tapes can be accommodated by the sleeve. With knowledge of the inventive concept, other sleeve and gap dimensions will be apparent to the skilled person.

The head assembly 10 further comprises a guide arrangement to guide the adhesive tape on its path from the feed spool to the tape launching cutter and also thereafter to the deposition zone. In this embodiment, the guide arrangement comprises multiple freely rotating guide rollers 26 along the path—these guide rollers 26 may be arranged in pairs or in isolation. The guide rollers 26 can be positioned to maintain tension in the tape, and also to keep the tape away from components of the assembly other than the tape launching cutter. The guide rollers may have surfaces made of a low friction material. In other embodiments, the guide arrangement may be a non-roller guide part, such as a stationary contact rod with a low friction surface that allows the tape to slip therepast.

In this embodiment, the freely rotating guide rollers 26 include a separation roller pair 261, 262 that is configured to facilitate separation of the tape 12 from its liner 14 as it flows past. Each roller 261, 262 of the pair of separation rollers overlap along the path of the tape to force a bend in the flowing tape that encourages the separation. One 261 of the rollers draws away the tape, and the other 262 draws away the liner. In this embodiment, the liner contacting roller 262 of the pair has a high friction surface so that it grips the liner to further facilitate separation. The tape contacting roller 261 of the pair also has a high friction surface so that it grips the tape to further facilitate separation in this embodiment. In other embodiments, the high friction surfaces may not be provided.

In this embodiment, the guide arrangement further comprises two sliders 27 to prevent any accidental bending of tape that may cause loss of contact between the rollers and the tape. In other examples, the sliders may not be present, or a different number of sliders may be provided, e.g. only one slider, or three or more sliders. The sliders are fixed sliders in this example and allow the tape to slide smoothly past; they prevent the tape from straying away from the desired travel path.

In the above-described embodiments, two sided cutting is described, i.e. where the tape launching cutter comprises a first cutting member 32*m* and a second cutting member 34*m*, wherein one or both of the first cutting member 32*m* and the second cutting member 34*m* are movable and are arranged to cooperatively cut the tape during the cutting operation. The tape is engaged from both sides during the cutting operation—the first cutting member 32*m* is arranged to cut the tape from a first side of the tape, and the second cutting member 34*m* is arranged to cut the tape from a second, opposite side of the tape. This leads to a more accurate, reliable cutting mechanism. This is particularly useful when cutting heavy or magnetic tape. Similarly, engaging the tape from both sides whilst launching leads to a more accurate, reliable launching mechanism.

In the above-described embodiments, the first cutting member 32*m* comprises a first cutting surface 32*s* and the second cutting member 34*m* comprises a second cutting surface 34*s*—two corresponding blades are provided, e.g. in a scissor-type arrangement. In other two-sided cutting embodiments (i.e. where the tape is engaged from both sides), one of the first cutting member 32*m* and the second cutting member 34*m* may be a cutting surface and the other of the first cutting member 32*m* and the second cutting member 34*m* may be a counterpart cutting base or cutting block, e.g. in a guillotine type arrangement.

In this embodiment, the controller 38 is arranged to control operation of the tape launching cutter based on various received information. The received information includes object speed information relating to the relative speed of the object compared to the head assembly, and presence information relating to detection of the presence of the object at a first location (or, in other embodiments, a relative position of the object compared to the head assembly). As a result, tape is able to be deposited on objects that arrive in the deposition zone irregularly spaced apart (as shown schematically in FIG. 1), as well as when regularly spaced apart. Presence information and object speed information triggers timing of appropriate action of the tape launching cutter.

In this embodiment, the conveyor rollers 4 are driven at a desired speed in response to user input via a machine user interface. Therefore the object speed is known. This object speed information is sent to the controller 38 via the machine or via the user interface, e.g. via a wired or wireless communication device.

In other embodiments, there may be provided a conveyor roller speed sensor arranged to measure the actual speed of rotation of one or more of the conveyor rollers 4. In other embodiments, there may be provided a conveyor system speed sensor arranged to measure the actual speed of movement of the conveyor. Object speed information is thereby generated. This object speed information is then sent to the controller 38, e.g. via a wired or wireless communication device.

In other embodiments, there may be provided an object speed sensor located on the machine to detect the object speed and generate object speed information. This object speed information is then sent to the controller 38, e.g. via a wired or wireless communication device.

In other embodiments, the assembly may comprise an object speed sensor to detect the object speed and generate object speed information. This object speed information is then sent to the controller 38, e.g. via a wired or wireless communication device.

In some embodiments, the movement between the object and the head assembly is precisely predetermined or plotted, and the object speed information and presence (or position) information is known in advance—sensing is not required to arrive at the information. This may apply especially in cases where the head assembly moves and the object is stationary.

In embodiments where the object speed information is sensed by an object speed sensor, the object speed may be sensed close to the deposition zone, e.g. after the object has passed the first press roller 28, e.g. the object speed sensor may be located (either on the assembly or on the machine) between the first press roller and the deposition zone. Or, the object speed sensor may be located more remotely, but may sense speed in the region close to the deposition zone (e.g. between the first press roller and the deposition zone.

In this embodiment the head assembly 10 comprises a launch sensor 40 arranged to detect the presence of the object at the first location. The first location is upstream of the deposition zone 8, and conveyed objects pass by the first location shortly before arriving at the deposition zone, in this embodiment. Also, in this embodiment, the first location is in between the first press roller 28 and the deposition zone 8. A compact arrangement is thereby provided.

The launch sensor 40 generates the presence information. This presence information is then sent to the controller 38, e.g. via a wired or wireless communication device.

In other embodiments, the assembly does not comprise the launch sensor. Instead, the launch sensor is located remotely of the assembly, e.g. on the machine itself. In other embodiments a launch sensor is not needed because the precise pattern (velocity and position) of movement between the object or objects and the head assembly is pre-programmed.

In this embodiment, the assembly 10 comprises the controller 38. In other embodiments, the controller 38 is located remotely of the assembly and communicates with the motor by, e.g., wired or wireless connection.

In response to the object speed information, the tape is launched at a specific speed, and cutting is synchronised therewith (based on the length of tape required). In response to the presence information, the tape is launched.

Given the object speed information and the presence information, the controller 38 controls movement of the servomotor to drive movement of the tape launching cutter between its various configurations in a desired manner to achieve precise launching and cutting of tape pieces. Precisely launched tape (including magnetic or heavy tape) adheres reliably to objects as a result. In this embodiment, the controller 38 is arranged to control operation of the servomotor to drive the tape launching cutter to launch the tape immediately in response to an object's presence being detected. In some embodiments the object speed information is taken into account to introduce a delay as required for accurate desired initial contact position between the tape and the object.

The controller 38 similarly controls movement of the tape launching cutter to the cutting configuration based on the required length of tape (e.g. programmed by a user) and the object speed information. Due to accurate attachment between the assembly and the machine, the time taken for the tape to travel between the tape launching cutter and the deposition zone, and the predicted time of arrival of the object at the deposition zone is precisely known or calculable.

Therefore, in response to the object speed information, the tape is launched at a certain speed, and cutting is synchronised. Similarly, in response to the presence information, the tape is precisely launched.

In other embodiments, an alternative launching and cutting mechanism is provided. The common element between embodiments is that launching and cutting is co-ordinated to achieve efficient cutting. The invention works in a continuous process without stopping the substrate. This is achieved because of the cutter cutting precisely as launched tape is being fed past.

In some embodiments, instead of a combined rotating launching and cutting roller arrangement, the tape launching cutter comprises a launch mechanism co-ordinated with a cutting mechanism. The co-ordinated launch and cutting mechanisms may be driven by a single motor via co-ordinating gearing arrangement in order to provide the advantage of consistency and repeatability between the launch and cutting phases, and also the release phase (in embodiments where the release phase is present). The tape launching cutter is arranged to carry out the tape launching operation upstream of the tape cutting operation.

The launch mechanism may be in the form of one, or a pair of, first rotating rollers comprising a launch portion arranged to grip and move the tape to launch the tape, and optionally the one, or pair of, first rotating rollers is further arranged to subsequently release the tape to allow the tape to flow freely past the launch portion.

Figure 7:
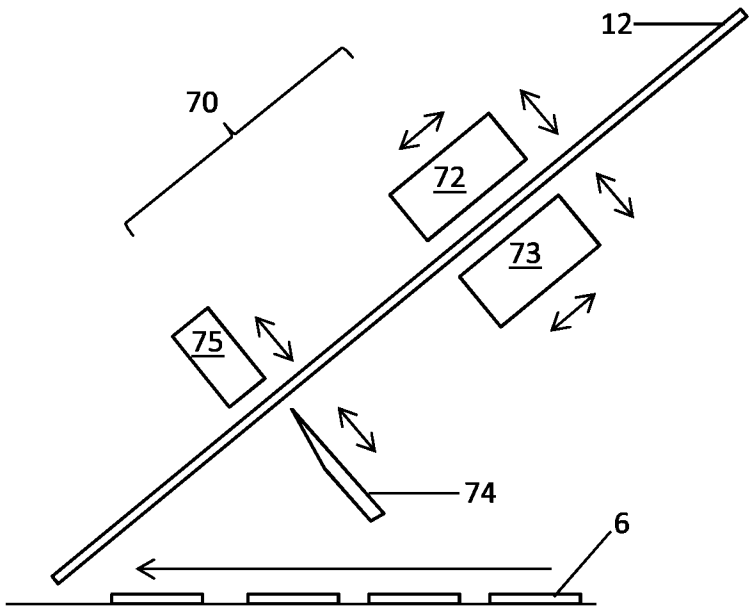
FIG. 7 shows schematically an adhesive tape dispenser head assembly according to another aspect of the invention.

Or, in some embodiments, such as the embodiment shown schematically in FIG. 7, the launch mechanism may be in the form of a linearly movable launch mechanism, such as a linearly movable clamp arrangement having a pair 72, 73 of linearly movable clamp members arranged to launch the adhesive tape, wherein the movable clamp members are arranged to grip and move the tape. Optionally, the movable clamp members are further arranged to subsequently release the tape to allow the tape to flow past the launch mechanism. In the embodiment shown in FIG. 7, the movable clamp members 72, 73 are able to move parallel to and also perpendicular to the tape 12 being conveyed therepast. The clamp members are able to grip, move and release the tape as required.

In co-ordinated combination, the launch mechanism is combined with a cutting mechanism. The cutting mechanism may be in the form of a movable guillotine cutter having a cutting blade 74 and a cutting block 75, wherein relative movement between the cutting blade and the cutting block is coordinated to cut the tape. In this embodiment, the cutting blade 74 and the cutting block 75 are both movable (in a co-ordinated manner) substantially perpendicularly to the direction of travel of the launched tape 12. In other embodiments, the cutting block may be stationary, and only the blade moves.

Together, the launch and cutting mechanisms form a co-ordinated launcher and cutter 70, whose movement is driven by a motor controlled by a controller 38—the controller 38 is responsible for co-ordinating launch and cutting to achieve efficient launching, cutting and depositing at speed. In other embodiments, separate motors may be provided for the launcher and for the cutter, yet their movements are still co-ordinated.

Or, in other embodiments, the cutting mechanism may be in the form of a pair of second rotating rollers comprising a cutting blade and a cutting block, wherein relative movement between the cutting blade and the cutting block is coordinated to cut the tape.

Or, the cutting mechanism may be in the form of a pair of second rotating rollers comprising a first cutting blade and a second cooperating cutting blade, wherein relative scissor movement between the first and second cutting blades is coordinated to cut the tape.

Or, the cutting mechanism may be in the form of a single second roller comprising a cutting blade and arranged to cut the tape under tension.

Or, the cutting mechanism may be in the form of a rotating cutting blade and a stationary cutting block, wherein relative movement between the cutting blade and the cutting block is coordinated to cut the tape, and optionally wherein the cutting block is formed from an internally rectified cylinder and the rotating cutting blade is mounted concentrically with the internally rectified cylinder—using an internally rectified cylinder to create the cutting components facilitates the required high accuracy during manufacturing.

A rotating launch mechanism can be combined with a rotating cutting mechanism, or a linearly movable cutting mechanism. A linearly movable mechanism can be combined with a rotating cutting mechanism, or a linearly movable cutting mechanism.

The invention covers a dispenser head assembly and also a machine having the claimed assembly, as well as a method of automatically dispensing tape onto moving objects in an efficient manner.

The assembly comprises a back plate and a front plate—components of the assembly are attached to one, other or both plates. FIGS. 2 to 6 show one plate removed for ease of viewing components. The plates facilitate stable, aligned mounting for components, protect the components of the assembly, and also provide safety (accident prevention) for operators of the assembly and machine from the moving parts.

Figure 8:
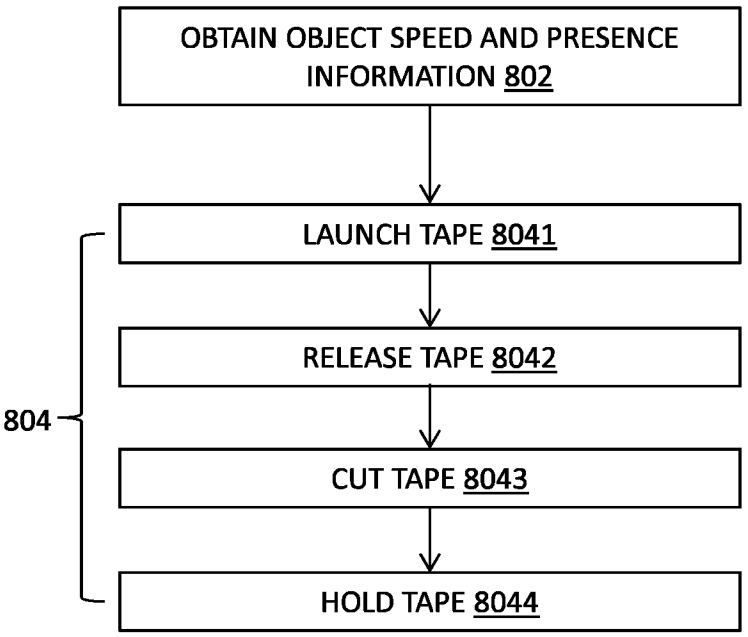
FIG. 8 is a flowchart depicting a method according an aspect of the invention.

Referring to FIG. 8, a method 800 of an embodiment dispenses pieces of adhesive tape 12 onto a moving object 6. The method comprises: obtaining 802 object speed and presence information; and based on the object speed and presence information, using 804 the tape launching cutter of any previously described embodiment to launch, cut and dispense pieces of adhesive tape onto the object. Upon initial contact between the tape and the object, the speed of the tape substantially matches the speed of the object. In this example the method is carried out by a computer controller 38. In some embodiments, at step 802, the controller 38 has information passed to it by one or more sensors; in other embodiments, at step 802, the controller 38 has knowledge (e.g. from pre-programming of the relative movement pattern between the object and the head assembly) of the object speed and presence (or position) information. The controller 38 may request information on the relative movement between the head assembly and the object; or in other embodiments, the controller 38 is passed said information without requesting.

Using 804 the tape launching cutter of the invention to cut and dispense pieces of adhesive tape onto the object comprises (e.g. in response to detecting the presence of the object, or knowing that the object is a specific time or distance away from the deposition zone) launching 8041 the tape, releasing 8042 the tape (for a required time to achieve desired tape length—based on the tape launching speed, which itself is based on object speed information), cutting 8043 the tape (at a co-ordinated time based on the required tape piece length taking into account the launched tape speed) and holding 8044 the tape (for as long as required based on the object speed and the desired spacing between tape pieces). Subsequently, in response to the next presence detection or when the next piece of tape is to be applied according to position information, the method comprises again launching the tape—this may occur immediately or after a calculated delay time. The delay time is calculated based on the speed of object (from the object speed information) and the presence information and knowledge of the distance the tape has to travel from the tape moving cutter to the deposition zone where it first contacts the moving object. In some embodiments, the release and holding steps are optional.

In some embodiments, the using 804 the tape launching cutter also comprises braking (not shown in FIG. 8).

In some embodiments, the moving object is conveyed on a conveyor system. In some embodiments, obtaining object speed information comprises determining the object speed from the conveyor system speed (e.g. by measuring the speed of the conveyor belt, or the conveyor roller(s) or a desired conveyor speed input by a user).

In other embodiments, obtaining object speed information comprises measuring the object speed (e.g. via an object speed sensor).

In other embodiments, the object speed information is input via a machine user interface or assembly head user interface, which is arranged to receive a desired speed input from a user, and obtaining object speed information comprises receiving (by the controller 38) a signal from the user interface (without having to directly sense speed of the object or of the moving conveyor system).

In some embodiments, object speed information (gathered via any of the above-mentioned options) is fed continuously to the controller 38. In other embodiments, the object speed information may be fed periodically (e.g. a few times a second, or every few seconds) to the controller 38. In other embodiments, the object speed information is passed to the controller 38 when the desired speed is set (e.g. by a user via the user interface at the start of the tape depositing process for a particular roll of tape), and then again when the desired speed is changed (for example if a user alters a desired object speed on a machine user interface) or at the start of a new roll. In between desired speed changes, there may be no further object speed information passed to the controller 38—it is assumed that the speed is unchanged; or, there may be an object speed information update passed to the controller 38 if no further object speed information has been passed to the controller 38 for a predetermined time interval, e.g. 5 minutes—(useful in case conditions (e.g. environmental conditions) have changed sufficiently to materially affect the operation of the machine and thereby the object speed.

The tape has two sides and the tape launching cutter is arranged to engage the tape from both sides. This provides more reliable launching and cutting.

The described methods can work with a head assembly according to any of the described embodiments.

Various modifications to the described embodiments that fall within the scope of the claims will now be apparent to the skilled reader.

In all embodiments, the dispenser head assembly is inventive in isolation of any machine to which it is installed, and may be used with different machines. A machine including the inventive dispenser head assembly comprises a further aspect of the invention.

The tape launching cutter may comprise a pair of co-operating endless tracks instead of a pair of co-operating rollers. The tape launching cutter may comprise an endless track instead of a roller.

Instead of a servomotor, another precisely controllable motor may be used in any embodiment.

In some embodiments, objects may be moved past the dispenser head assembly with a different moving arrangement other than a conveyor belt or conveyor rollers.

In some embodiments, any one or more of the controller 38, the launch sensor and the one or more object speed sensors may be on the head assembly (as described in one of the above-mentioned embodiments). In other embodiments, any one or more of the controller 38, the launch sensor and the one or more object speed sensors may not be on the head assembly—instead, any one or more of these components may be located on the machine only. In yet further embodiments, any one or more of the controller 38, the launch sensor and the one or more object speed sensors may be located remotely of on the head assembly and the machine—in the case of the launch sensor and the one or more object speed sensors, their location relative to the deposition zone would be known.

In general across all embodiments, tape cutting and depositing (especially for heavy or magnetic tape) is improved relative to known systems by launch speed matching (i.e. ideally, the tape is launched such that the relative velocity between the tape and the object is about zero upon initial contact between the tape and the object) or two-sided cutting or two-sided launching or braking before cutting or any combination thereof, amongst other things.

Figure 9:
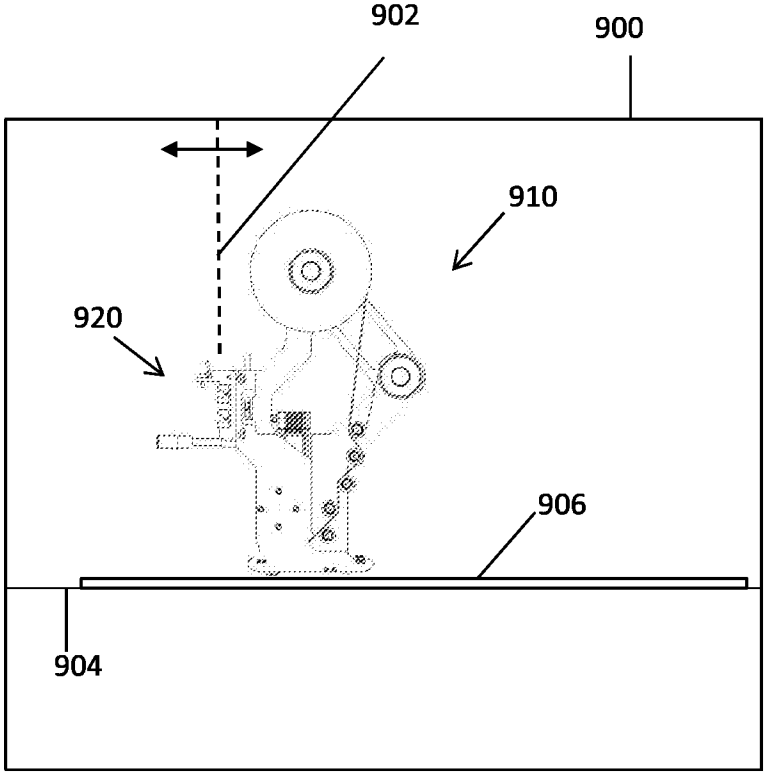
FIG. 9 shows schematically parts of a tape application machine according to another aspect of the invention.

The described embodiments largely relate to a fixed head assembly past which moving objects, upon which tape is to be deposited, move. In other embodiments, the inventive head assembly can be used with other arrangements. Any suitable relative movement mechanism arranged to provide relative movement between an object or objects upon which tape pieces are to be adhered and the head assembly can be provided. E.g. in FIG. 9 there is shown an X-Y plotter type machine 900, having a frame 902 to which is attached (via attachment device 920) a moving head assembly 910 (able to move across the machine in at least two orthogonal directions) and a fixed object 906 or substrate to which tape is to be adhered. The object is located on a stationary work bed 904—the positional alignment between the bed 904 and the object 906 is known, as is the positional alignment between the head assembly 910 and the frame machine 900 (via the frame 902), as is the positional alignment between the bed 904 and the machine 900—therefore, the precise alignment between the head assembly and the object 906 is also known. The size of the work area/bed is usually a few m.sup.2, e.g. 2 m×3 m. In such machines, typically each object is aligned with the bed in a known position, and a controller 38 (located on the assembly or on the machine) has access to, and is able to use, this information to control movement (including speed and position) of the head relative to the bed to deposit tape on the object in a desired manner. The head assembly of this invention can be used to provide reliable, consistent, high quality adhering of tape piece(s) in a similar manner to that described in relation to previous embodiments. The controller 38 controls launching and cutting of the tape from the moving head assembly on to the stationary object taking into account the relative position and the relative speed between the head assembly and the object. All features of the previous embodiments can work with this embodiment. In other embodiments, both the head assembly and the object(s) move, and launching and cutting are controlled by taking into account the relative position and the relative speed between the head assembly and the object(s).

The invention claimed is:

1. An adhesive tape dispenser head assembly arranged to dispense pieces of adhesive tape onto an object, the assembly comprising:

a feed spool arranged to hold adhesive tape; and a tape launching cutter movable between a first configuration in which the tape launching cutter is arranged to launch the adhesive tape onto a moving object and a second configuration in which the tape launching cutter is arranged to cut the tape to a desired length, wherein the tape launching cutter is movable to a fourth configuration in which a holding portion of the tape launching cutter is arranged to hold a remaining portion of tape fed from the spool after a piece of tape has been cut from it, and prior to a subsequent launch of the tape, and wherein the tape launching cutter is arranged to move in sequence from the second configuration to the fourth configuration.

2. The adhesive tape dispenser head assembly of claim 1, wherein the tape launching cutter comprises a first cutting member and a second cutting member, and wherein one or both of the first cutting member and the second cutting member are movable and are arranged to cooperatively cut the tape during the cutting operation.

3. The adhesive tape dispenser head assembly of claim 2, wherein the first cutting member is arranged to cut the tape from a first side of the tape, and the second cutting member is arranged to cut the tape from a second, opposite side of the tape.

4. The adhesive tape dispenser head assembly of claim 2, wherein:

the first cutting member comprises a first cutting surface and the second cutting member comprises a second cutting surface; or one of the first cutting member and the second cutting member comprises a cutting surface and the other of the first cutting member and the second cutting member comprises a counterpart cutting base.

5. The adhesive tape dispenser head assembly of claim 1, wherein the tape has two sides and the tape launching cutter is arranged to engage the tape from both sides during the launch operation, the cutting operation, or both.

6. The adhesive tape dispenser head assembly of claim 1, wherein the tape launching cutter includes a servomotor, and the servomotor is arranged to receive instructions from a controller arranged to control operation of the tape launching cutter.

7. The adhesive tape dispenser head assembly of claim 6, wherein the controller is arranged to control operation of the tape launching cutter based on either or both of:

object speed information relating to the relative speed of the object compared to the dispenser head assembly; and presence information relating to detection of the presence of the object at a first location or position information relating to the relative position of the object compared to the dispenser head assembly.

8. The adhesive tape dispenser head assembly of claim 1, further comprising a press roller located at or near to the location of initial contact between the adhesive tape and the object.

9. The adhesive tape dispenser head assembly of claim 1, wherein the adhesive tape is provided on a backing liner layer, the feed spool is arranged to hold the adhesive tape and the backing liner layer, and the adhesive tape dispenser head assembly further comprises a take-up spool arranged to collect the backing liner layer.

10. The adhesive tape dispenser head assembly of claim 1, wherein the tape launching cutter is arranged to carry out the tape launching operation upstream of the tape cutting operation.

11. A tape application machine comprising an adhesive tape dispenser head assembly according to claim 1, and a relative movement mechanism arranged to provide movement between the object and the dispenser head assembly, wherein the adhesive tape dispenser head assembly is arranged to dispense pieces of adhesive tape onto the object.

12. An adhesive tape dispenser head assembly arranged to dispense pieces of adhesive tape onto an object, the assembly comprising:

a feed spool arranged to hold adhesive tape; and a tape launching cutter movable between a first configuration in which the tape launching cutter is arranged to launch the adhesive tape onto a moving object and a second configuration in which the tape launching cutter is arranged to cut the tape to a desired length, wherein the tape launching cutter comprises a pair of rotating rollers comprising a launch portion arranged to grip and move the tape to launch the tape, and a cutting portion having a cutting surface arranged to cut the tape, and wherein the rollers are arranged to rotate between the first and second configurations.

13. An adhesive tape dispenser head assembly arranged to dispense pieces of adhesive tape onto an object, the assembly comprising:

a feed spool arranged to hold adhesive tape; and a tape launching cutter movable between a first configuration in which the tape launching cutter is arranged to launch the adhesive tape onto a moving object and a second configuration in which the tape launching cutter is arranged to cut the tape to a desired length, wherein the tape launching cutter comprises:

a pair of first rotating rollers comprising a launch portion arranged to grip and move the tape to launch the tape, wherein the tape launching cutter is formed by a coordinated launcher and cutter coordinated by a controller, the launcher comprising a movable clamp arrangement having a pair of linearly movable clamp members arranged to launch the adhesive tape.

* * * * *